US009605495B2

(12) United States Patent
Reinås et al.

(10) Patent No.: US 9,605,495 B2
(45) Date of Patent: Mar. 28, 2017

(54) PRESSURE JOINT

(75) Inventors: Lorents Reinås, Stavanger (NO); Tore Geir Wernø, Sandnes (NO); Alastair Buchanan, Stavanger (NO)

(73) Assignee: STATOIL PETROLEUM AS, Stavanger (NO)

( * ) Notice: Subject to any disclaimer, the term of this patent is extended or adjusted under 35 U.S.C. 154(b) by 1147 days.

(21) Appl. No.: 13/266,245

(22) PCT Filed: Apr. 26, 2010

(86) PCT No.: PCT/EP2010/055565

§ 371 (c)(1), (2), (4) Date: Dec. 7, 2011

(87) PCT Pub. No.: WO2010/125031

PCT Pub. Date: Nov. 4, 2010

(65) Prior Publication Data

US 2012/0091705 A1 Apr. 19, 2012

(30) Foreign Application Priority Data

Apr. 27, 2009 (GB) ..... 0907222.4

(51) Int. Cl.

*E21B 17/01* (2006.01)
*E21B 17/07* (2006.01)
*E21B 19/00* (2006.01)

(52) U.S. Cl.

CPC ..... *E21B 17/07* (2013.01)

(58) Field of Classification Search

CPC ..... E21B 17/01; E21B 17/07; E21B 19/006; F16L 27/00

USPC ..... 166/355, 345, 367; 285/145.1, 223, 302; 405/224.2, 224.4

See application file for complete search history.

(56) References Cited

U.S. PATENT DOCUMENTS

| | | | | |
|---|---|---|---|---|
| 5,069,488 | A * | 12/1991 | Freyer et al. | 285/302 |
| 6,148,922 | A * | 11/2000 | Vatne | 166/367 |
| 6,173,781 | B1 * | 1/2001 | Milne et al. | 166/355 |
| 6,447,021 | B1 * | 9/2002 | Haynes | 285/302 |
| 8,127,854 | B2 * | 3/2012 | Haheim | 166/367 |
| 2006/0219411 | A1 * | 10/2006 | Moksvold | 166/345 |
| 2008/0066922 | A1 * | 3/2008 | Blakseth et al. | 166/350 |
| 2011/0005767 | A1 * | 1/2011 | Muff et al. | 166/345 |

FOREIGN PATENT DOCUMENTS

| | | | |
|---|---|---|---|
| GB | 2358032 | A | 7/2001 |
| WO | WO 90/05236 | A1 | 5/1990 |
| WO | WO 95/17576 | A1 | 6/1995 |
| WO | WO 03/067023 | A1 | 8/2003 |

* cited by examiner

*Primary Examiner* — Matthew R Buck
(74) *Attorney, Agent, or Firm* — Birch, Stewart, Kolasch & Birch, LLP

(57) ABSTRACT

A pressure joint is provided for use with a floating installation (1) that is connected to a stiff riser (3, 12). A low pressure slip joint (5) connects the installation (1) to the stiff riser (3, 12). A telescopic assembly (13, 14) fitted with a high pressure seal (15) is arranged to be fitted within the low pressure slip joint (5) when in a non-extended configuration, such that normal operation of the low pressure slip joint (5) is not impeded.

28 Claims, 5 Drawing Sheets

PRESSURE JOINT

Figure 1B:
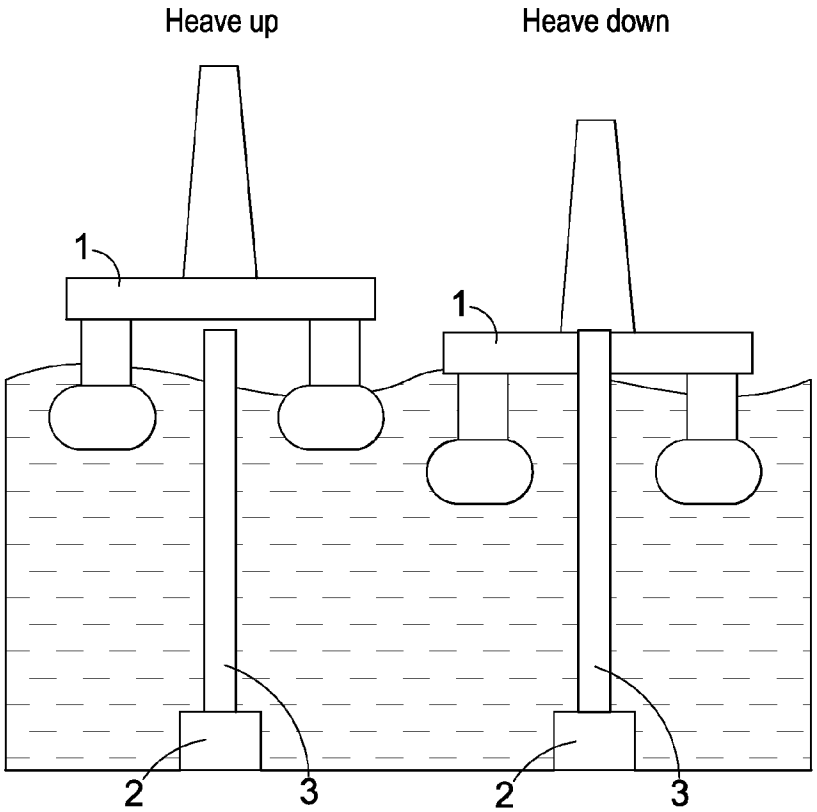

This invention relates to a pressure joint, for example of the sort used to connect stiff risers extending from a well head on the seabed to a vessel. Such a joint may be used with a marine intervention riser system for workover applications after a well has been drilled.

Drilling operations typically use risers comprising large diameter pipes, which extend upwards from the well head and through an opening in the bottom of a vessel such as a ship or floating rig. Drilling operations are carried out by means of a drill string within the riser. Drilling mud required for drilling is circulated from the vessel, down through the centre of the drill string to the drill bit at the bottom of the drill string, back up the wellbore and through an annular gap between the drill string and the riser.

When drilling operations are carried out in deep water, the riser faces the same stresses as any long vertical column, which could lead to structural failure under compressive loading. To avoid such failure, riser tensioning systems are installed to apply a tensile force to the upper end of the riser. A variety of such tensioning systems are known, including cables, sheaves and pneumatic cylinder mechanisms connected between the vessel and the upper portions of the riser.

As the riser is fixed at its lower end to the wellhead assembly on the seabed and at its upper end, by the tensioners, to a floating installation or vessel, it is necessary for motion of the installation caused by wind, wave and tidal action to be accommodated. Consequently, motion-compensating equipment must be incorporated into the tensioning system to maintain the top of the riser within the moon pool of a ship and at rig floor level. This may include a telescopic marine joint to compensate for heaving motion and a flex joint within the riser to compensate for lateral movement of the vessel. The telescopic marine joints used are well known and are referred to herein as slip joints.

A typical slip joint comprises concentric cylinders which are arranged to telescope relative to each other, with a dynamic seal provided between them. One cylinder is connected to the rig floor and the other to the upper end of the riser. As the vessel heaves up and down, the ship joint extends and compresses, thereby accommodating the movement whilst maintaining a sealed connection between the riser and the rig.

At the top of the slip joint there is a diverter packer which can be employed to divert gases which enter the riser away from the vessel floor. Such gases are occasionally encountered during drilling and are hazardous so there is a safety mechanism provided to divert them and burn them off or vent them.

The conventional slip joints are only capable of withstanding comparatively low pressures, the main limitation being the pressure that can be contained by a dynamic seal. During drilling, pressure inside the riser pipe is comparatively low and so this limitation is not problematic. Occasionally during drilling a shallow pocket of gas is encountered which might cause a temporary increase in pressure but in general drilling pressure is low.

A problem is, however, encountered, when workover operations are performed on the well. During such operations, there is a need to position intervention equipment so that it can access the well and the pressure during workover intervention is high.

The low pressure marine slip joint used in this context is typically designed to withstand a pressure of up to only 300 psi. typically using simply sealing mechanisms such as rubber air bladders. These are sufficient to seal the telescopic arrestor from the outside ocean and keep drilling fluids apart from the sea but they are simply not strong enough for workover operations.

Providing higher pressure telescopic connectors is possible but requires long and expensive polished sealing surfaces to be included on the units. Any dynamic seal, even at low pressures, significantly increases the cost and complexity of a telescopic connector. Achieving dynamic sealing that will accommodate the pressures experienced in workover operations imparts even greater difficulty in terms of producing such sealing surfaces. It is therefore highly desirable to avoid the need for such sealing systems. However, if a dynamic seal is not provided, there will inevitably be relative motion between the riser and associated workover apparatus and the vessel.

Marine intervention riser systems are functionally similar to risers used with mobile production platforms in terms of the pressures that are encountered but they are designed to allow a variety of devices to be inserted into the well. Use of these devices requires a considerable amount of human involvement and any system in which the risers in the moon pool or rig floor have a large vertical movement with respect to the vessel presents a serious safety hazard when humans are performing workover operations in the vessel. At these times, it is desirable to have no movement between the top of the riser assembly and the vessel. At other times, when personnel are not involved, relative motion between the top of the riser assembly and the vessel is acceptable.

The reconfiguration of the installation and/or additional components involved in the intervention system creates a significant burden in terms of lost time and technical complexity. Moreover, many intervention systems require large heights of essentially 'free-standing' components. For example, it may be necessary for a large portion of a slip joint to be free standing in air above the level of the riser tensioner and/or drill floor. This results in lateral instability issues under side loading, which can lead to operational problems resulting from accelerated wear at bushings, and 'stick/slip' problems.

WO 03/067023 discloses an assembly having a workover riser located partially within the rigid riser, with a telescoping sliding sealing connection extending above the rig floor lever. The sliding connection is disposed on the workover riser between the wellhead and the travelling block that is used to tension the workover riser. This sliding connection enables heave motion to be absorbed whilst the surface valve connected to the workover riser is held stationary relative to the rig floor level. To provide a high pressure seal, the sliding connection is stroked into its extended configuration, by tensioning the workover riser with the travelling block, before workover operations that require pressurisation take place. This causes a high pressure sealing device to engage and the sliding connection is locked in this position during such operations. However, some free-standing height is always present and, as the sliding connection includes a low pressure seal, the workover riser is expensive and complex to construct.

Viewed from a first aspect, the present invention provides a pressure joint apparatus for use with a floating installation that is connected to a stiff riser, the apparatus comprising: a low pressure slip joint for connecting the installation to the stiff riser; and a telescopic assembly fitted with a high pressure seal, wherein the telescopic assembly is arranged to be fitted within the low pressure slip joint when in a non-extended configuration, such that normal operation of the low pressure slip joint is not impeded.

The telescopic assembly is placed at least partially within the slip joint in its non-extended configuration, so that operations can continue as normal. Typically, this requires the telescopic assembly to be below a floor level of the installation when non-extended. In a preferred embodiment, the telescopic assembly is housed completely within the slip joint when non-extended. The non-extended length of the telescopic assembly may correspond to the non-extended length of the slip joint.

As the collapsed high pressure assembly is included within the slip joint system, which is preferably a conventional slip joint, normal overbalanced drilling can proceed without the need for removal/installation of the components necessary for high pressure intervention. The low pressure slip joint provides the low pressure envelope required for overbalanced operation, and the telescopic assembly can simply be extended when required for high pressure operations. This enables rapid reconfiguration between high pressure intervention and low pressure drilling operational modes. It will be appreciated that the telescopic assembly could be removed from the low pressure slip joint if required and put into the slip joint only when required but one of the benefits of the present solution is that such addition/removal operations are not required. Also, the location of the telescopic assembly inside the low pressure slip joint means that the telescopic assembly is fully supported with respect to lateral (bending) loads and so wear and tear on the joint in motion is greatly reduced.

Preferably the high pressure seal is a non-dynamic seal, and there is no dynamic seal fitted to the telescopic assembly. In WO 03/067023, whist the workover riser includes a non-dynamic high pressure seal, the pressure joint assembly disclosed also requires dynamic low pressure sealing to be provided in the sliding connection of the workover riser when it is used to absorb heave motion. The present inventors have realised that the need for even the low pressure dynamic seal places significant constraints on the design of the high pressure joint. For example, it requires long and expensive sealing surfaces to be provided.

To address this problem, which is not considered in the prior art, the low pressure slip joint is used to provide the necessary low pressure seal, allowing the telescopic assembly to be constructed using just a non-dynamic high pressure seal, without an additional dynamic seal. This makes it simpler to design, and enables an increased stroke length without significantly affecting the complexity or cost of manufacturing. Low pressure sealing, when required, is provided by the concentric low pressure slip joint seal that is already in place in almost all current floating production vessels and is effectively redundant with conventional intervention heave arrestor solutions. The present invention hence achieves high pressure operation without dynamic sealing in the high pressure joint. Dynamic sealing is very difficult under high pressures and the seal requirements are onerous. The use of a fixed high pressure seal, without the need for any low pressure dynamic sealing in the high pressure joint, makes the solution cheap and easy to implement. The non-dynamic high pressure seal may be achieved by any convenient technique.

The telescopic assembly may be integrated with the low pressure slip joint, with a high pressure connection between the lower (fixed) part of the slip joint and the lower part of the telescopic assembly. The high pressure connection along with the non-dynamic high pressure seal, when activated, can provide the high pressure envelope required for underbalanced operation.

The apparatus preferably incorporates a seal for sealing about the upper portion of the telescopic assembly. This seal provides a way to complete the low pressure envelope when the telescopic assembly extends up to, or above, a floor level of the installation. In this configuration, the telescopic assembly is free to extend to absorb heave motion, whilst a low pressure seal is maintained to isolate the riser contents from the installation. The seal about the upper portion of the telescopic assembly may be a diverter packer.

The telescopic assembly may include fitments at its upper end for connection to intervention equipment. Preferably, the telescopic assembly is arranged such that intervention equipment can be skidded and/or jacked onto the upper end thereof at a floor level of the floating installation. The capability for intervention equipment to be skidded and/or jacked onto the telescopic assembly arises, in the limiting case, when the upper end of the telescopic assembly is at a floor level of the installation in its fully non-extended state. Preferably however, the upper end of the telescopic assembly can be withdrawn some distance beneath floor level, in order to allow for a degree of heave motion to be accommodated whilst the upper end is at floor level. The telescopic assembly may have full non-extended and extended lengths roughly equivalent to the non-extended and extended lengths of slip joint in which it is fitted. This enables working at the floor level to continue across the full range of movement of the slip joint.

The use of skidding/jacking handling systems for intervention equipment at floor level is advantageous compared to other techniques, such as craning. Craning heavy equipment on a moving vessel is obviously undesirable and craning also requires sufficient space between the vessel floor and any structures thereabove to allow for safe crane operation. By skidding the heavy equipment, no lifting apparatus is required at all. The prior art systems do not allow for skidding/jacking handling for intervention equipment at drill deck level. The present invention, where the telescopic assembly can be withdrawn into the slip joint, eliminates the need for personnel to work at height with man-riding equipment. This therefore enables significant improvement in safety and working environment by reduction/removal of man-riding and working at height operations as these can be carried out at floor level.

In a preferred embodiment, the telescopic assembly is secured at floor level by hanging the upper end off the floor level. Thus, the apparatus is preferably provided with means for hanging the upper end off the floor level. The means may comprise flanges.

The apparatus of the aspects discussed above may include a mechanical lock (or locks) between sections of the telescopic assembly. These locks may be arranged to be activated in the fully collapsed position and/or the fully extended position (alternatively in any position). This may be used for surface handling and installation purposes. In the case of a mechanical lock in the fully extended position, this may also be used to allow the entire extended assembly to tolerate compression loads and allow a surface intervention package to be supported axially by a lower riser tensioner system.

Some prior art solutions to intervention employ a wear casing around the installed high pressure workover riser. As the high pressure joint of this invention is located within the low pressure slip joint, the present invention does not require a wear casing.

Viewed from a second aspect, the present invention provides a method of providing a pressure joint between a floating installation and a stiff riser, the method comprising:

providing a low pressure slip joint between the installation and the riser; and providing a telescopic assembly within the low pressure slip joint, the telescopic assembly being fitted with a high pressure seal; wherein the telescopic assembly is housed within the low pressure slip joint when in its non-extended configuration, such that normal operation of the low pressure slip joint is not impeded.

In a preferred embodiment, the telescopic assembly is fully within the low pressure slip joint when in the non-extended state.

Preferably, the high pressure seal is a non-dynamic high pressure seal, and the method comprises activating the non-dynamic high pressure seal during high pressure operation to provide a high pressure envelope within the telescopic assembly, and using the low pressure slip joint to provide a low pressure envelope under low pressure operation such that the telescopic assembly does not require a dynamic seal.

Under low pressure operation, a seal may be provided about the upper portion of the telescopic assembly.

The method may include extending the telescopic assembly for connection to intervention equipment. Preferably, the method includes extending the telescopic assembly to a floor level of the floating installation, then skidding and/or jacking the intervention equipment onto the upper end of the telescopic assembly. A preferred embodiment comprises securing the telescopic assembly at floor level by hanging the upper end off the floor level.

The use of a telescopic assembly with a non-dynamic high pressure seal housed within a low pressure slip joint to remove the need for the telescopic assembly to have any form of dynamic seal is advantageous even when the telescopic assembly cannot collapse sufficiently to allow normal operation to proceed. Therefore, a further aspect of the invention provides a pressure joint apparatus for use with a floating installation that is connected to a stiff riser, the apparatus comprising: a low pressure slip joint for connecting the installation to the stiff riser; and a telescopic assembly fitted with a non-dynamic high pressure seal, wherein the telescopic assembly is arranged to be fitted at least partially within the low pressure slip joint, such that the low pressure slip joint provides a dynamic low pressure seal and wherein the telescopic assembly thereby requires no dynamic seal.

In this aspect, the omission of any form of dynamic seal from the telescopic assembly means that the high pressure parts can be more easily and cheaply produced, as discussed above. Preferably, the apparatus includes a non-dynamic seal arranged to seal about an upper part of the telescopic assembly. When the telescopic assembly protrudes above a floor level of the installation, a further seal is required to complete the low pressure envelope enclosed by the slip joint. This non-dynamic seal may be a diverter packer as above.

In another aspect, the present invention encompasses a method of providing a pressure joint between a floating installation and a stiff riser, the method comprising: providing a low pressure slip joint between the installation and the riser; and providing a telescopic assembly within the low pressure slip joint, the telescopic assembly being fitted with a non-dynamic high pressure seal; wherein the telescopic assembly is housed at least partially within the low pressure slip joint, such that the low pressure slip joint provides a dynamic low pressure seal and the telescopic assembly thereby requires no dynamic seal.

The term "low pressure slip joint" is used herein to describe a slip joint suitable for providing a low pressure envelope, as required in overbalance operation for example. Such a slip joint may typically comprise a first part for connection to the riser, a second part for connection to the vessel and a low pressure dynamic seal for accommodating movement between the two parts whilst maintaining the low pressure envelope. Similarly, the term "high pressure seal", whilst in its broadest construction meaning simply a seal capable of resisting a pressure higher than the low pressure slip joint, preferably takes the meaning of a high pressure seal as known in the art for use in underbalanced operation. In this context, "low pressure" is normally around 50 bar or less, though occasionally it may mean up to 300 bar. "High pressure" is typically from around 300 bar and greater.

Figure 1A:
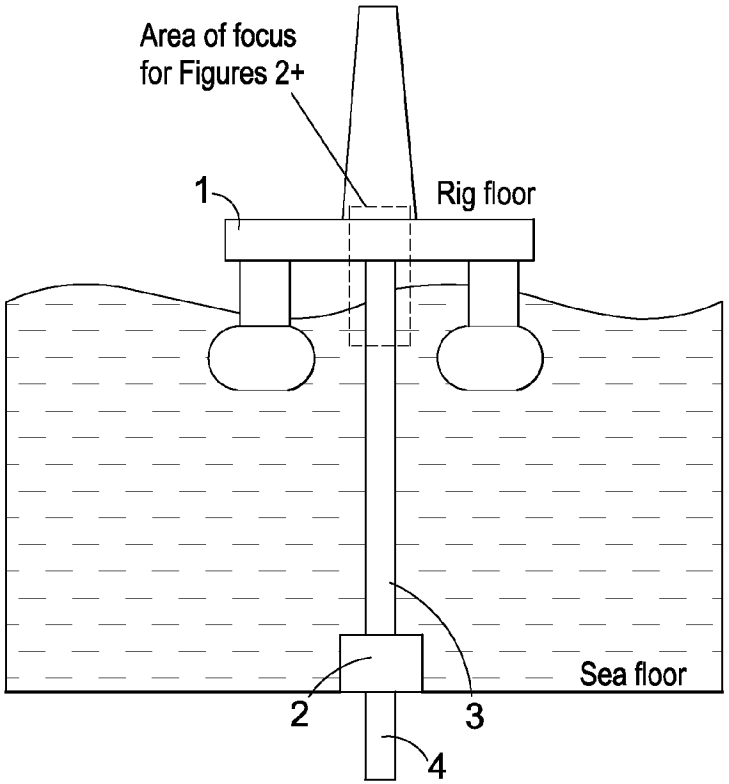
Figure 2B:
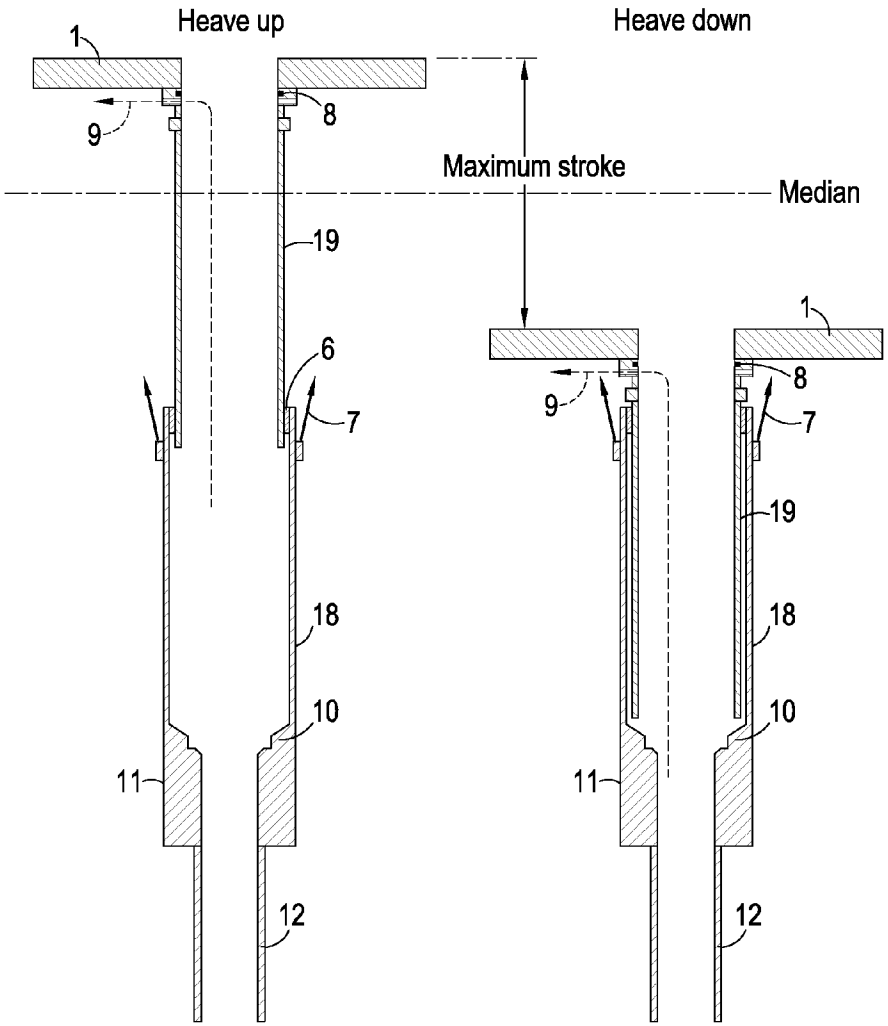
Figure 2A:
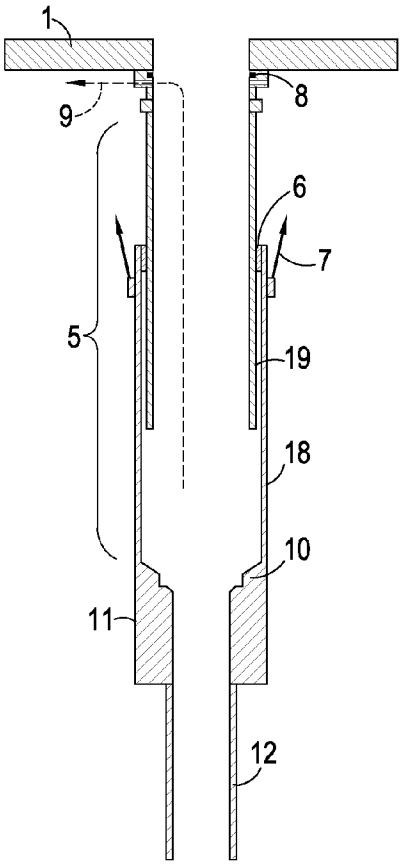

An embodiment of the invention will now be described, by way of example only, and with reference to the accompanying drawings, in which:

FIG. 1*a* is a schematic elevation of a conventional prior art arrangement of a semi-submersible rig connected to a wellbore using a stiff riser;

FIG. 1*b* shows elevations of the rig of FIG. 1*a* illustrating the effect of heave on the relative positions of the riser and the rig;

FIG. 2*a* is a sectional view of the marine slip joint used in the apparatus of FIGS. 1*a* and 1*b;*

Figure 3B:
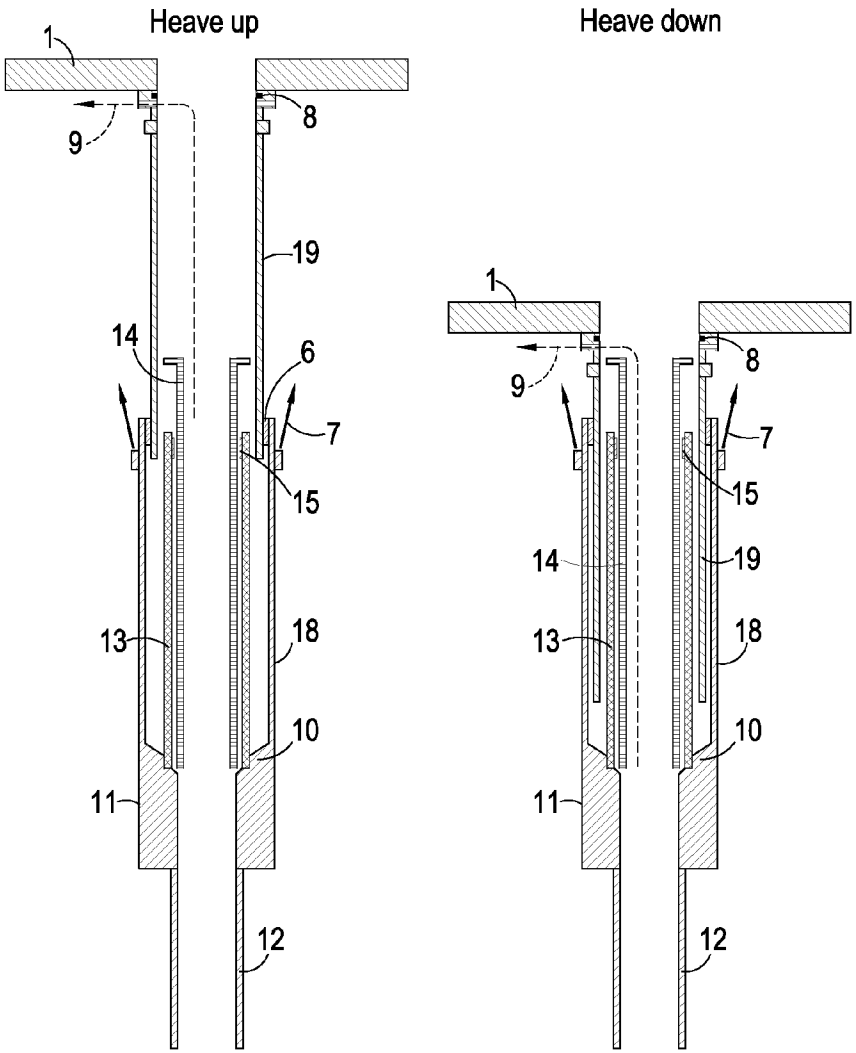
Figure 3A:
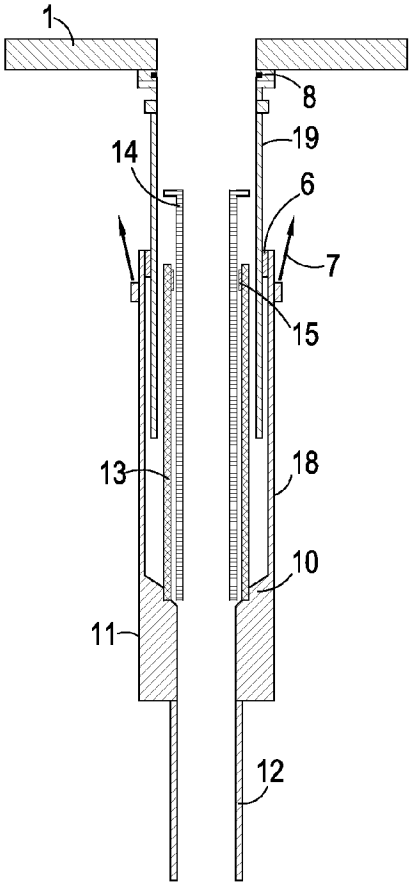

FIG. 2*b* shows elevations of the marine slip joint of FIG. 2*a* in two extreme positions illustrating the handling of heave;

FIG. 3*a* is a sectional view of a marine slip joint including a high-pressure adaptor according to an embodiment of the present invention, the adaptor being in inactive mode (i.e. installed but not in use);

FIG. 3*b* shows elevations of the marine slip joint of FIG. 3*a*, with the high-pressure adaptor (in inactive mode) shown in two extreme positions illustrating the handling of heave.

Figure 4B:
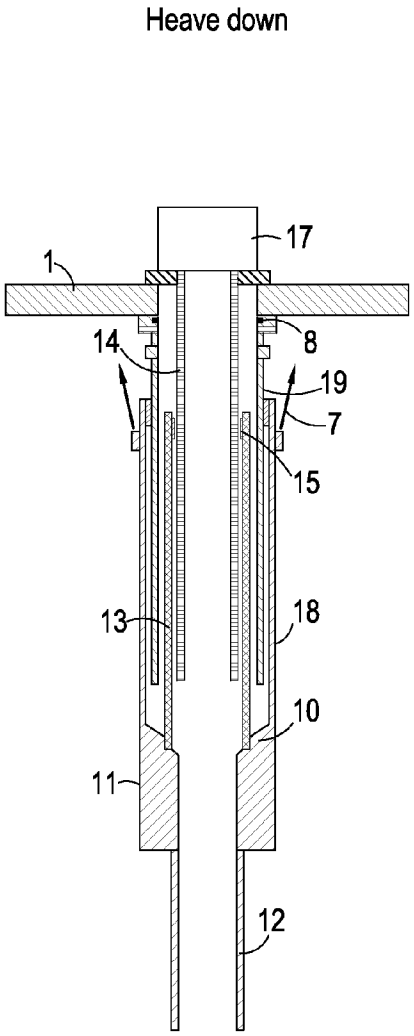
Figure 4A:
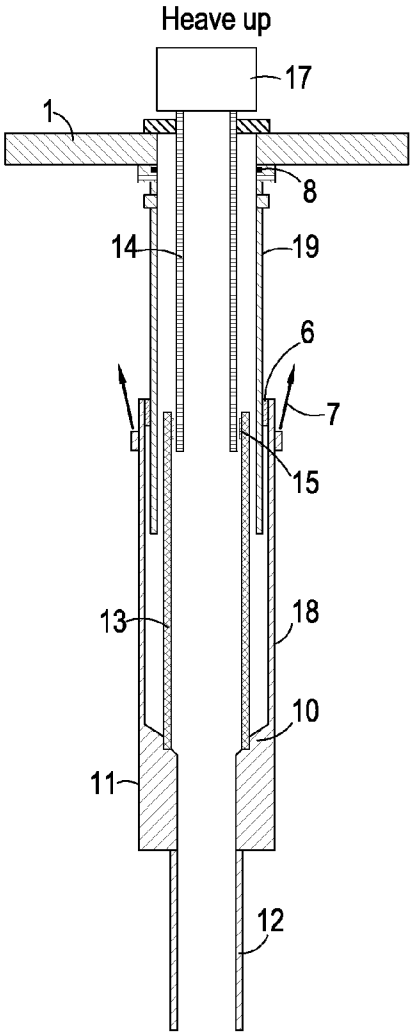
Figure 4A:
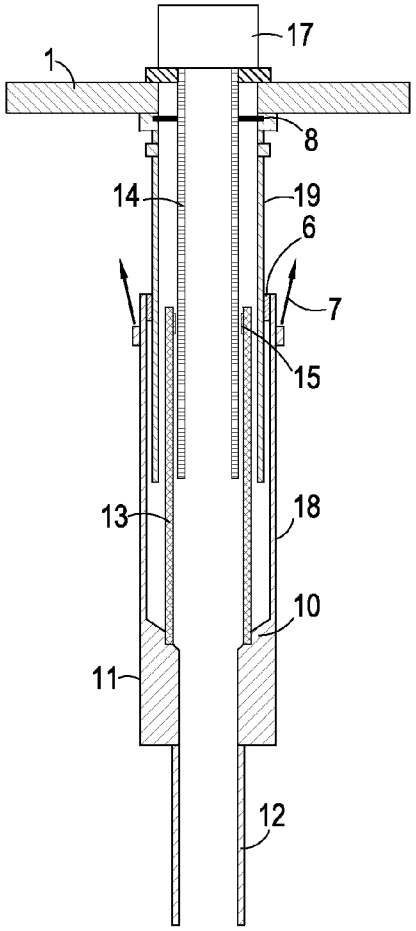
Figure 5B:
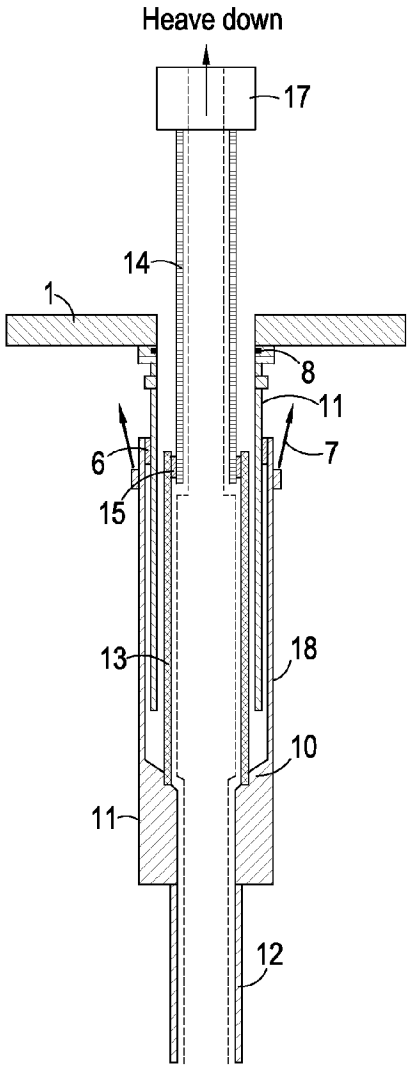
Figure 5A:
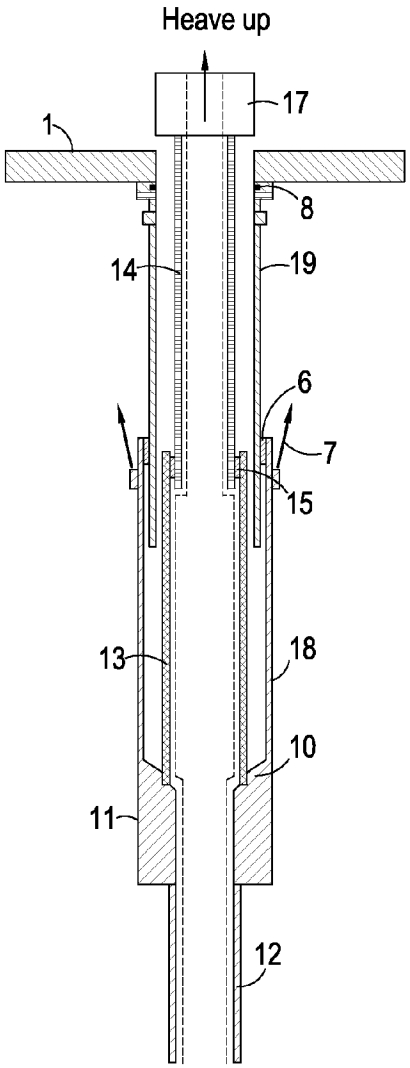
Figure 5A:
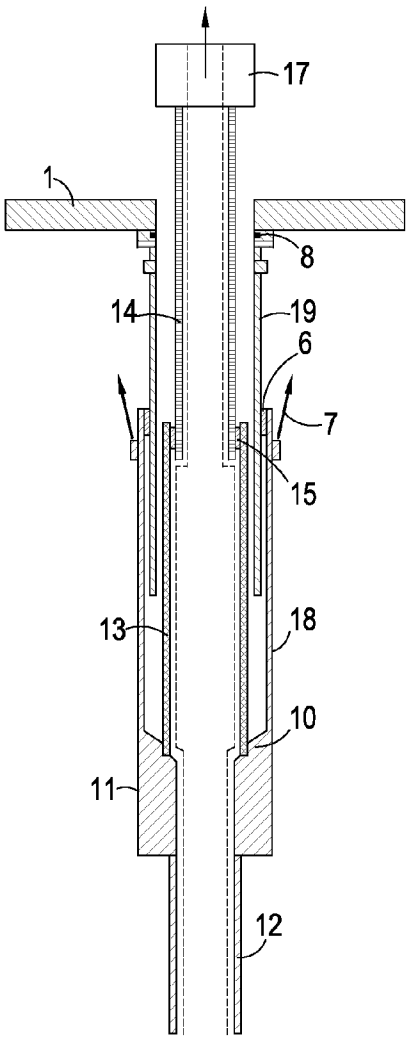

FIGS. 4*a* and 4*b* are sectional views corresponding to FIGS. 3*a* and 3*b*, in which the high pressure adaptor is hung off at the rig floor; and FIGS. 5*a* and 5*b* are sectional views corresponding to FIGS. 3*a* and 3*b*, in which the high-pressure adaptor is in active mode (live well configuration).

FIG. 1*a* illustrates a schematic of a conventional arrangement in which a semi-submersible rig 1 is connected to a wellbore 4. A wellhead/valve tree 2 is located at the sea floor and a stiff riser 3 is used to create a connection between the valve tree 2 and the rig allowing circulation/flow of fluids between the well and the rig while providing fluid and pressure containment.

The effect of heave on the relative position of the riser 3 to the rig 1 can be seen from FIG. 1*b*. In response to changes in the sea level (e.g. due to wind, waves, tides, etc.), the rig moves up and down repeatedly ("heave"), whereas the stiff riser 3, which is effectively fixed relative to the sea-floor, does not move. This unavoidable situation creates challenges in maintaining a suitable connection between the riser 3 and rig 1 while still maintaining the key functions of fluid and pressure containment.

FIG. 2*a* is a depiction of a conventional marine slip joint (drilling heave arrester) 5. This basic configuration is used on virtually all semi-submersible drilling units in use worldwide. The figure shows the area directly below the drill or rig floor where the connection between the stiff riser 12 and the rig 1 is generally located. The slip joint 5 comprises two concentric cylinders. The inner (upper) slip joint cylinder 19 is connected to the rig 1 and the outer (lower) cylinder 18 is connected to the riser 12. Riser tensioners (whose position is indicated by arrows 7) are normally connected at the top of the outer (lower) cylinder 18; these maintain tension in the riser regardless of the motion of the rig 1 and the inner slip joint cylinder 19. A low-pressure dynamic seal 6 is provided between the inner 19 and outer 18 slip joint cylinders. It maintains a fluidtight connection between them regardless of the heave motion of the rig 1 relative to the stiff riser 12.

Located between the low-pressure slip joint 5 and the rig floor is a return flow line (the path of which is indicated by arrow 9) for drilling fluids from the well. Adjacent to it is a diverter packer 8 that can be closed on any pipe or assembly lowered into the riser to prevent riser fluids escaping directly to the rig floor.

FIG. 2*b* illustrates the extreme positions of the low-pressure slip joint 5 as the rig heaves up and down. This shows the maximum allowable movement (full stroke) which is commonly around 16 m for standard drilling units (but can also be greater or less than this). In practice the amount of heave that can be tolerated for normal drilling operations is around +/−2.25 m (i.e. 4.5 m total)—beyond this level a series of contingency operations are implemented to avoid exceeding the maximum limit of the slip joint. (This can ultimately involve disconnecting from the sea-floor valve tree.)

The slip joint as described is, however, unsuitable for operation under high pressure, e.g. where workover operations are carried out within the riser. The embodiment described hereinafter solves this problem using a high pressure adaptor located within the low pressure slip joint, which can remain in the low pressure slip joint during low pressure (overbalanced) operation but can be activated easily when high pressure (underbalanced) operation is required.

The low pressure slip joint systems previously described are designed primarily for overbalanced drilling operations—that is to say under normal operating conditions when there is zero pressure in the riser at the surface (drill floor level). However, for live well intervention operations that are normally conducted with the well in underbalance, it is necessary to have high pressure containment all the way from the sea floor valve tree 2 to the rig floor where supplementary well intervention pressure containing equipment will be installed. It will be appreciated that in the arrangement illustrated in FIG. 2, the high-pressure containment envelope extends only to a point below the conventional low-pressure slip joint. The embodiment described below completes the high-pressure envelope to the rig floor in a manner compatible with safe and efficient live well intervention.

FIG. 3*a* shows an embodiment of the invention which comprises a slip joint of the kind previously described, to which has been added a high-pressure adaptor that takes the form of a telescopic assembly. The adaptor is illustrated in an inactive mode (i.e. installed but not in use).

The telescopic assembly has an inner barrel 14 and an outer barrel 13. The latter is sealingly connected at its lower end via a high-pressure connection 10 to the outer cylinder 13 of the slip joint (which is in turn connected to the high pressure riser 12 which extends all the way down to the valve tree at the sea floor and which is provided with a blowout protector (BOP) 11). The inner barrel 14 is free to move in a telescoping manner relative to the outer barrel 13. Between the two barrels there is provided a non-dynamic high-pressure seal 15, which is arranged to provide a seal between them when activated.

In the standby mode illustrated, the inner barrel 14 is located largely within the outer barrel 13 and the seal 15 is not in use. Thus, the high-pressure adaptor is contained entirely within the marine slip joint 5. This allows normal overbalanced drilling operations to proceed as before (see FIG. 2) without interference from the high-pressure adapter.

The use of the high pressure adaptor when changing from overbalanced drilling to underbalanced live well intervention will now be described, with reference to FIGS. 4*a* and 4*b*.

The first step is for the isolation valves in the valve tree to be closed. Thus, at this point there is no well pressure in the riser.

Next, the inner barrel 14 of the high-pressure adapter is extended upwardly relative to the outer barrel 13 and hung off at the rig floor level. At this stage, the inner and outer barrels are free to telescope in response to heave, in the same manner as the low-pressure joint. This allows supplementary intervention, well control and other equipment 17 to be installed above the inner barrel, using skidding/jacking equipment of the type that is standard for fixed platform operations, at rig-floor level whilst the effect of heave is still isolated below the rig floor. This avoids the need for installation of the well intervention equipment in an elevated tension frame high above the rig-floor level.

It will be appreciated that in this mode there is no requirement for any dynamic sealing between the barrels of the high pressure slip-joint adapter. There is no (or low) pressure in the riser 12 and the riser slip joint 5 continues to operate as before. If low pressure dynamic sealing is required (to isolate the rig floor from the riser contents) then it is achieved by closing the diverter packer 8 around the upper barrel of the adapter 14—the existing low pressure seal 6 on the standard slip joint 5 then provides the necessary dynamic seal. The high pressure adaptor has no pressure sealing capability in this configuration, but rather acts as a simple guide for any tools inserted in the inner bore of the system.

Once the intervention well control equipment has been installed, and bottom hole assembly, etc. operations have been completed, it is possible to establish a high-pressure connection with the sea-floor valve tree. This is done by stroking out the high-pressure adapter into the fully extended configuration shown in FIG. 5*a*, and then activating the high-pressure seal 15 to create a non-dynamic seal between the inner 14 and outer 13 barrels of the adaptor. Thus, the barrels are held in the extended configuration with a high-pressure seal between them. The high-pressure seal 15 is activated by the application of tension to the adaptor. However, in other embodiments other activation methods can be used, such as external hydraulic activation.

As may be seen from FIG. 5*b*, in this configuration, heave continues to be accommodated by the low-pressure slip joint 5 so that the rig continues to move relative to the riser 12. However, the surface intervention equipment 17 is now fixed in position relative to the riser 12 (and hence the wellbore) by means of the extended adaptor and therefore it moves relative to the rig floor. At this point the rig floor can be clear of workers and therefore this does not create a safety problem.

Once the high-pressure seal is established and tested, the isolation valves on the sea-floor valve tree can be opened to gain access to the wellbore and conduct the planned intervention operation.

Rigging down and/or reverting to overbalanced mode is the reverse of the described procedure.

Whilst two telescoping cylinders are conveniently used in the high pressure adaptor of the embodiment discussed above, three or more cylinders could also be employed, with a corresponding increase in the number of non-dynamic high pressure seals. Note also that whilst in the preferred embodiment the largest cylinder will be at the bottom of the heave arrestor when extended, the orientation of the cylinders (i.e. whether the outermost cylinder is at the top of the assembly or at the bottom) can be reversed, if desired.

The invention claimed is:

1. A pressure joint apparatus for use with a floating installation that is connected to a stiff riser, the pressure joint apparatus comprising:

a low pressure slip joint for connecting the installation to the stiff riser, the low pressure slip joint comprising an inner cylinder, an outer cylinder, and a low pressure dynamic seal; and a telescopic assembly, the telescopic assembly comprising an inner barrel, an outer barrel, and a high pressure seal, wherein the inner cylinder, the outer cylinder, the inner barrel and the outer barrel each intersect at least one common plane perpendicular to a longitudinal axis of the low pressure slip joint, wherein the telescopic assembly, in its entirety, is arranged to be fitted within the low pressure slip joint when in a non-extended configuration, such that normal operation of the low pressure slip joint is not impeded, and wherein the telescopic assembly is arranged to extend outside the low pressure slip joint when in an extended configuration, and the inner barrel is fixed with respect to the outer barrel when in the extended configuration.

2. The pressure joint apparatus as claimed in claim 1, wherein the telescopic assembly is disposed below a floor level of the installation when in the non-extended configuration.

3. The pressure joint apparatus as claimed in claim 1, wherein the telescopic assembly is housed completely within the slip joint when in the non-extended configuration.

4. The pressure joint apparatus as claimed in claim 3, wherein the non-extended length of the telescopic assembly corresponds to the non-extended length of the slip joint.

5. The pressure joint apparatus as claimed in claim 1, wherein the high pressure first seal is a non-dynamic seal.

6. The pressure joint apparatus as claimed in claim 5, wherein there is no dynamic seal fitted to the telescopic assembly.

7. The pressure joint apparatus as claimed in claim 1, wherein the telescopic assembly is integrated with the low pressure slip joint with a high pressure connection between a lower part of the slip joint and a lower part of the telescopic assembly.

8. The pressure joint apparatus as claimed in claim 1, further comprising a second seal for sealing about an upper portion of the telescopic assembly.

9. The pressure joint apparatus as claimed in claim 8, wherein the second seal is a diverter packer.

10. The pressure joint apparatus as claimed in claim 1, wherein the telescopic assembly includes fitments at its upper end for connection to intervention equipment.

11. The pressure joint apparatus as claimed in claim 10, wherein the telescopic assembly is arranged such that intervention equipment can be skidded and/or jacked onto the upper end thereof at a floor level of the floating installation.

12. The pressure joint apparatus as claimed in claim 1, wherein the telescopic assembly has full non-extended and extended lengths substantially equivalent to the extended and non-extended lengths of slip joint.

13. The pressure joint apparatus as claimed in claim 1, wherein the telescopic assembly is secured at floor level of the installation by hanging its upper end off the floor level.

14. The pressure joint apparatus as claimed in claim 13, further comprising a member on which the upper end is hung off the floor level.

15. The pressure joint apparatus as claimed in claim 14, wherein the member is flanges.

16. The pressure joint apparatus as claimed in claim 1, further comprising a mechanical lock (or locks) between sections of the telescopic assembly.

17. The pressure joint apparatus as claimed in claim 16, wherein the or each lock is arranged to be activated in a fully collapsed position and/or a fully extended position.

18. A method of providing a pressure joint between a floating installation and a stiff riser, the method comprising:

providing a low pressure slip joint between the installation and the riser, the low pressure slip joint comprising an inner cylinder, an outer cylinder, and a low pressure dynamic seal; and providing a telescopic assembly within the low pressure slip joint, the telescopic assembly comprising an inner barrel, an outer barrel, and a high pressure seal, wherein the inner cylinder, the outer cylinder, the inner barrel and the outer barrel each intersect at least one common plane perpendicular to a longitudinal axis of the low pressure slip joint, wherein the telescopic assembly is housed within the low pressure slip joint when in its non-extended configuration, such that normal operation of the low pressure slip joint is not impeded, and wherein the telescopic assembly is arranged to extend outside the low pressure slip joint when in an extended configuration, and the inner barrel is fixed with respect to the outer barrel when in the extended configuration.

19. The method as claimed in claim 18, wherein the telescopic assembly is fully within the low pressure slip joint when in the non-extended configuration.

20. The method as claimed in claim 18, wherein the high pressure seal is a non-dynamic high pressure seal, and the method comprises activating the non-dynamic high pressure seal during high pressure operation to provide a high pressure envelope within the telescopic assembly, and using the low pressure slip joint to provide a low pressure envelope under low pressure operation such that the telescopic assembly does not require a dynamic seal.

21. The method as claimed in claim 18, wherein, under low pressure operation, a seal is provided about an upper portion of the telescopic assembly.

22. The method as claimed in claim 18, further comprising the step of extending the telescopic assembly for connection to intervention equipment.

23. The method as claimed in claim 22, wherein the step of extending further comprises the step of extending the telescopic assembly to a floor level of the floating installation, then skidding and/or jacking the intervention equipment onto an upper end of the telescopic assembly.

24. The method as claimed in claim 23, further comprising the step of securing the telescopic assembly at floor level by hanging the upper end off the floor level.

25. A pressure joint apparatus for use with a floating installation that is connected to a stiff riser, the pressure joint apparatus comprising:

a low pressure slip joint for connecting the installation to the stiff riser, the low pressure slip joint comprising an inner cylinder, an outer cylinder, and a low pressure dynamic seal; and a telescopic assembly, the telescopic assembly comprising an inner barrel, an outer barrel, and a non-dynamic high pressure seal, wherein the inner cylinder, the outer cylinder, the inner barrel and the outer barrel each intersect at least one common plane perpendicular to a longitudinal axis of the low pressure slip joint, wherein the telescopic assembly is arranged to be fitted at least partially within the low pressure slip joint comprising said low pressure dynamic seal such that the telescopic assembly thereby requires no further low pressure dynamic seal, and wherein the telescopic assembly is arranged to extend outside the low pressure slip joint when in an extended configuration, and the inner barrel is fixed with respect to the outer barrel when in the extended configuration.

26. The pressure joint apparatus as claimed in claim 25, further comprising a non-dynamic seal arranged to seal about an upper part of the telescopic assembly.

27. The pressure joint apparatus as claimed in claim 26, wherein the non-dynamic seal is a diverter packer.

28. A method of providing a pressure joint between a floating installation and a stiff riser, the method comprising:

providing a low pressure slip joint between the installation and the riser, the low pressure slip joint comprising an inner cylinder, an outer cylinder, and a low pressure dynamic seal; and providing a telescopic assembly within the low pressure slip joint, the telescopic assembly comprising an inner barrel, an outer barrel, and a non-dynamic high pressure seal, wherein the inner cylinder, the outer cylinder, the inner barrel and the outer barrel each intersect at least one common plane perpendicular to a longitudinal axis of the low pressure slip joint, wherein the telescopic assembly is housed at least partially within the low pressure slip joint comprising said low pressure dynamic seal such that the telescopic assembly thereby requires no further low pressure dynamic seal, and wherein the telescopic assembly is arranged to extend outside the low pressure slip joint when in an extended configuration, and the inner barrel is fixed with respect to the outer barrel when in the extended configuration.

* * * * *